United States Patent [19]

Kratt et al.

[11] Patent Number: 4,994,787

[45] Date of Patent: Feb. 19, 1991

[54] REMOTE INTRUSION ALARM CONDITION ADVISORY SYSTEM

[75] Inventors: Robert W. Kratt, 22481 Walnut Cir. S., Cupertino, Calif. 95014; James C. Sprout, Los Altos, Calif.

[73] Assignee: Robert W. Kratt, Cupertino, Calif.

[21] Appl. No.: 356,521

[22] Filed: May 25, 1989

[51] Int. Cl.[5] ..... G08B 26/00; G08B 1/08

[52] U.S. Cl. ..... 340/505; 340/539; 340/531; 340/527

[58] Field of Search ..... 340/505, 506, 531, 539, 340/541, 573, 527, 528, 825.06–825.14, 825.54, 825.69, 825.72, 825.32, 825.36; 455/73, 67, 78, 89, 90, 53, 54

[56] References Cited

U.S. PATENT DOCUMENTS

| | | | |
|---|---|---|---|
| 3,350,687 | 10/1967 | Gabrielson et al. | 340/825.09 |
| 3,441,929 | 4/1969 | Coffer et al. . | |
| 3,641,539 | 2/1972 | Lesher . | |
| 3,703,714 | 11/1972 | Andrews | 340/539 |
| 3,833,895 | 9/1974 | Fecteau | 340/505 |
| 3,882,465 | 5/1975 | Cook et al. | 340/825.54 |
| 4,012,728 | 3/1977 | Fowler . | |
| 4,024,519 | 5/1977 | Galvin et al. . | |
| 4,222,052 | 9/1980 | Dunn | 340/505 |
| 4,422,068 | 12/1983 | Helft et al. | 340/506 |
| 4,532,498 | 7/1985 | Gilmore . | |
| 4,594,580 | 6/1986 | Nelson | 340/539 |
| 4,794,368 | 12/1988 | Grossheim et al. | 340/528 |
| 4,833,449 | 5/1989 | Graffigan | 340/531 |
| 4,839,642 | 6/1989 | Batz et al. | 340/825.06 |

*Primary Examiner*—Donnie L. Crosland
*Attorney, Agent, or Firm*—John J. Leavitt

[57] ABSTRACT

A sensor for monitoring the status of an alarm system is disclosed. The sensor includes a base station at the location of the alarm system and arranged to respond to an alarm condition. When an alarm occurs, the base station latches the alarm condition and retains it until it is manually reset. A remote station includes a transceiver for interrogating the base station to determine whether an alarm condition has occurred. The remote unit may also be used to arm or disarm the alarm system, and to operate other controllable devices.

14 Claims, 7 Drawing Sheets

FIG. 1
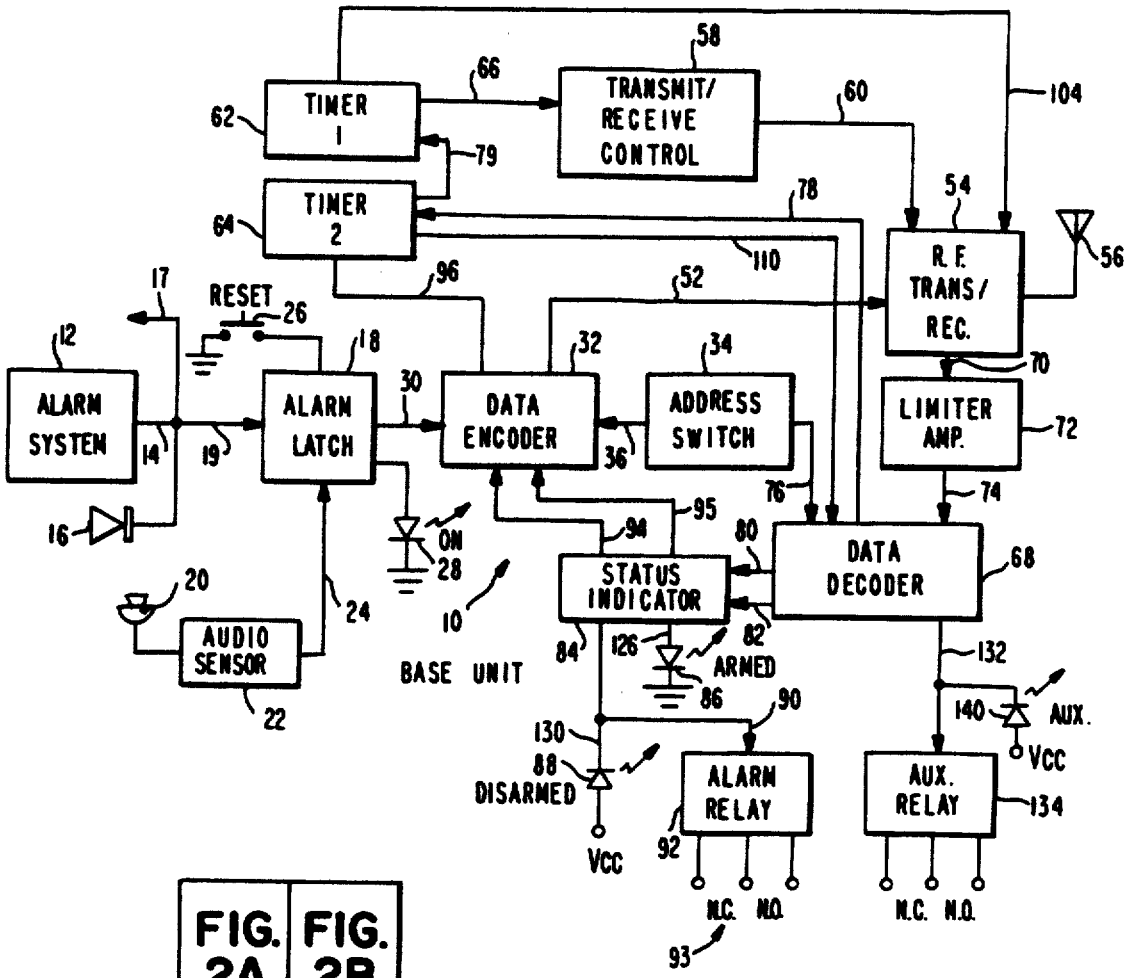
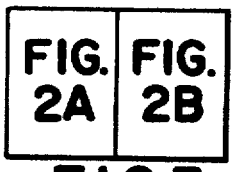
FIG. 3
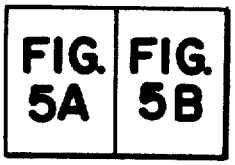
FIG. 6
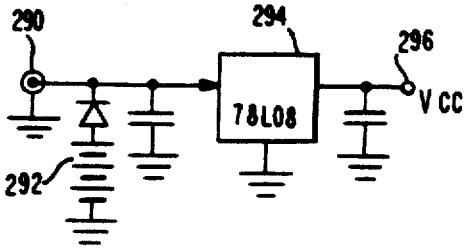
FIG. 7

REMOTE INTRUSION ALARM CONDITION ADVISORY SYSTEM

BACKGROUND OF THE INVENTION

The present invention relates, in general, to alarm system monitors, and more particularly to a remote controller for determining the status of an alarm system at a base station and for providing an indication of that status at the remote location.

Alarm systems for homes, apartments, offices, recreational vehicles, boats and the like are widely used and provide a convenient method for protecting such locations against intrusion. Such systems typically activate an audible or visible alarm, and may also send alarm signals to remote central stations for monitoring. However, many such systems have an automatic shut-off after a predetermined period of time, so that when the owner returns there may be no indication that the alarm had been activated. In cases where an intruder who tripped the alarm is still on the premises being protected, the owner would have no warning of this existing threat. It has been found desirable, therefore, to provide apparatus for selectively and remotely monitoring an alarm system to determine its status and to provide an indication of whether the system has been activated, thereby increasing the safety and well being of the owner of the protected location.

SUMMARY OF THE INVENTION

The monitoring system of the present invention consists of a base unit within a residence, business, or other protected location and a portable remote transceiver which has the capability of retrieving status information from the base unit to enable an operator to determine whether the base unit has been activated. The primary function of the system is to provide the operator with an additional element of safety, since it will provide information as to whether an intrusion alarm has been tripped during the operator's absence. As a secondary feature, in addition to the status information mentioned above, the present system includes circuitry which permits the remote unit to arm or disarm the base unit and to selectively actuate an auxiliary control such as a garage door opener. Whenever any of these secondary functions are utilized, the status of the base unit is automatically retrieved so that the operator will know that the control instructions have been carried out.

More particularly, the base unit of the present invention is a compact, self-contained monitoring circuit located within a structure such as a residence or business and connected to respond to the operation of an independent alarm system. The remote unit is a battery operated portable unit which is sufficiently small and lightweight to allow it to be carried on the person of the operator, for example, the owner or resident of the premises being protected. The base and remote units are in communication with each other by a UHF radio link which is controlled by the portable unit. Preferably, the radio link uses transceivers at the base and remote stations operating at about 300 MHz with a range of about 75 feet. The base unit is a self-contained module which may be AC line powered with a battery back-up. In order to respond to the operation of an existing alarm system, the base unit may be directly wired to the existing system to obtain a positive, immediate notification of the alarm state, or may be acoustically connected to the alarm system to respond to the typical long duration sound of an alarm annunciator. Because the base unit is not an integral part of the alarm system, its detection of an alarm condition will not be changed when the alarm system itself is destroyed or turned off; an alarm condition is stored within the base unit using active logic circuitry until such time as the data is retrieved by the remote unit and the base unit is manually reset.

The remote hand-held unit is equipped with four push button switches and three lamps, in a preferred embodiment of the invention. The switches provide the user with remote capability to determine the status of the system without changing its condition, to arm the alarm system, to disarm the alarm system, and to operate an auxiliary device while the alarm system is in the off mode. The lamps contained within the remote unit advise the user of the condition and status of the alarm system upon activation of the remote unit. A green lamp, for example, indicates that the alarm system is armed and has not been disturbed. An amber lamp, for example, indicates that the alarm system is disarmed and has not been disturbed. Finally, a blinking red lamp, for example, indicates that the alarm system had been tripped since the system had been armed and warns the user of the threat that an intruder may still be within the protected premises. When the base unit detects the tripping of the alarm system, the base remains latched in the tripped, or alarm, mode until the base unit is manually reset, even if the alarm system itself is turned off or times out and shuts itself down.

The base unit includes an alarm latch which may be wired into the alarm system to respond to an electrical signal produced by the system, may be acoustically connected to the alarm system, or may be responsive to some other signal from an existing alarm system to sense an alarm condition. The alarm latch switches to an alarm mode, and remains in that mode until it is manually reset. The latch supplies an output signal to a data encoder, which also receives address signals from an adjustable address switch as well as other status signals indicating whether the alarm system is armed or disarmed. The output of the data encoder is a series of digital signals which provide the address of the base unit and its status. These digital signals are supplied to a transmit/receive circuit (transceiver) which is normally in the receive mode.

The receive portion of the base unit transmit/receive circuit is connected through an amplifier to a data decoder so that upon receipt of an address-coded inquiry signal from a remote unit, the received signal will activate the decoder and, if the receive signal carries the address of the base unit it will activate a pair of timers. The first timer provides a one second delay, after which the second timer switches the transmit/receive circuit to its transmit mode to transmit encoded status data from the data encoder. This data is transmitted for one second and then the base unit returns to its receive mode.

The remote unit includes four control switches for use in status retrieval and for use in setting the alarm unit or for controlling some auxiliary function. The controls activate a remote encoder which then produces corresponding encoded instruction signals, along with an encoded address which is supplied by an adjustable address switch. This adjustable address switch permits the address of the remote unit to be matched to the address of the base unit.

The remote unit includes a transmit/receive circuit (transceiver) which is controlled by a pair of timers responsive to the four control switches. Upon closing of the first control switch, which is a status retrieve switch, a first timer is activated to turn the power on in the remote unit for a period of ten seconds after release of the retrieve switch, and to activate the second timer to shift the transmit/receive circuit to its transmit mode for 0.7 seconds, after which the transceiver reverts to its receive mode. This causes the remote unit to transmit a status retrieve signal for 0.7 seconds, which signal is received, amplified, and sent to the decoder in the base unit. If the signal received by the base unit carries an address which matches its own address, the base data decoder activates the base unit to transmit a status signal. The transmitted status signal indicates whether the base unit is armed or disarmed, and whether the alarm has been activated. This signal is received by the remote unit, which has now shifted back to its receive mode, and the received signal is amplified and sent to a remote unit data decoder which again compares the address carried on the signal from the base unit with the address established by the remote unit address switch. If there is a match, the received data is decoded and sent to an appropriate indicator on the remote unit to indicate the status of the base unit.

The second control switch on the remote unit is an "arm" switch which causes the data encoder to transmit an arm (or "on") signal in the same manner that the data retrieve signal is sent, as discussed above. When an arm signal is received at the base unit and is decoded, it activates an alarm relay which will set an "arm" latch. This then produces an encoded signal which is sent back to the remote unit to indicate that the base unit is armed.

The remote unit also includes a disarm control switch which activates the remote unit to transmit a corresponding encoded signal which is received at the base unit and which disarms the alarm system relay in the base unit. Finally, the remote unit includes an auxiliary control switch which is transmitted in the same way as the status retrieve signal and which is encoded to activate an auxiliary relay at the base unit. The auxiliary relay can be used to control an auxiliary system, such as a garage door opening, connected to the auxiliary relay.

A typical use of the system of the present invention would be for a homeowner to leave his residence and lock the door behind him. Once clear of the structure, he would depress the "arm" switch of the remote unit, which would transmit an encoded signal to the base unit in the residence to activate the "arm" relay, thereby arming the base unit and switching on an alarm system in the residence. The base unit then sends back a signal indicating that the base unit is on, and activating, for example, an "on" indicator lamp to assure the homeowner that the alarm system has been set.

Upon his return home, the homeowner will depress the "status" switch to cause the remote unit to transmit a status retrieve signal. Upon receiving the status retrieve signal, the base unit would transmit the appropriate status signal, which would indicate whether the alarm system protecting the residence had been tripped during the homeowner's absence. If so, a flashing red light at the remote unit would indicate an alarm condition. If not, an "armed" signal would be returned, and the homeowner would then disarm the system by transmitting a disarm signal. After the base unit had been turned off, the auxiliary switch on the hand held unit could be used, for example, to open a garage door or to perform some other function through the use of the auxiliary relay on the base unit.

Both the base and the portable units are code programmable to provide security and to prevent interference from another system operating nearby. Such coding is provided by the use of a compact address switch located on each unit which can be easily modified by the user.

BRIEF DESCRIPTION OF THE DRAWINGS

The foregoing and additional objects, features and advantages of the present invention will become apparent to those of skill in the art from a more detailed consideration of a preferred embodiment thereof, taken in conjunction with the accompanying drawings, in which:

FIG. 1 is a block diagram of a base unit for the alarm condition monitoring system of the present invention;

FIG. 3 illustrates the relationship of FIGS. 2A and 2B;

FIG. 6 illustrates the relationship between FIGS. 5A and 5B;

FIG. 7 is a schematic diagram of a power supply for the base unit; and

DETAILED DESCRIPTION OF PREFERRED EMBODIMENT

Figure 2A:
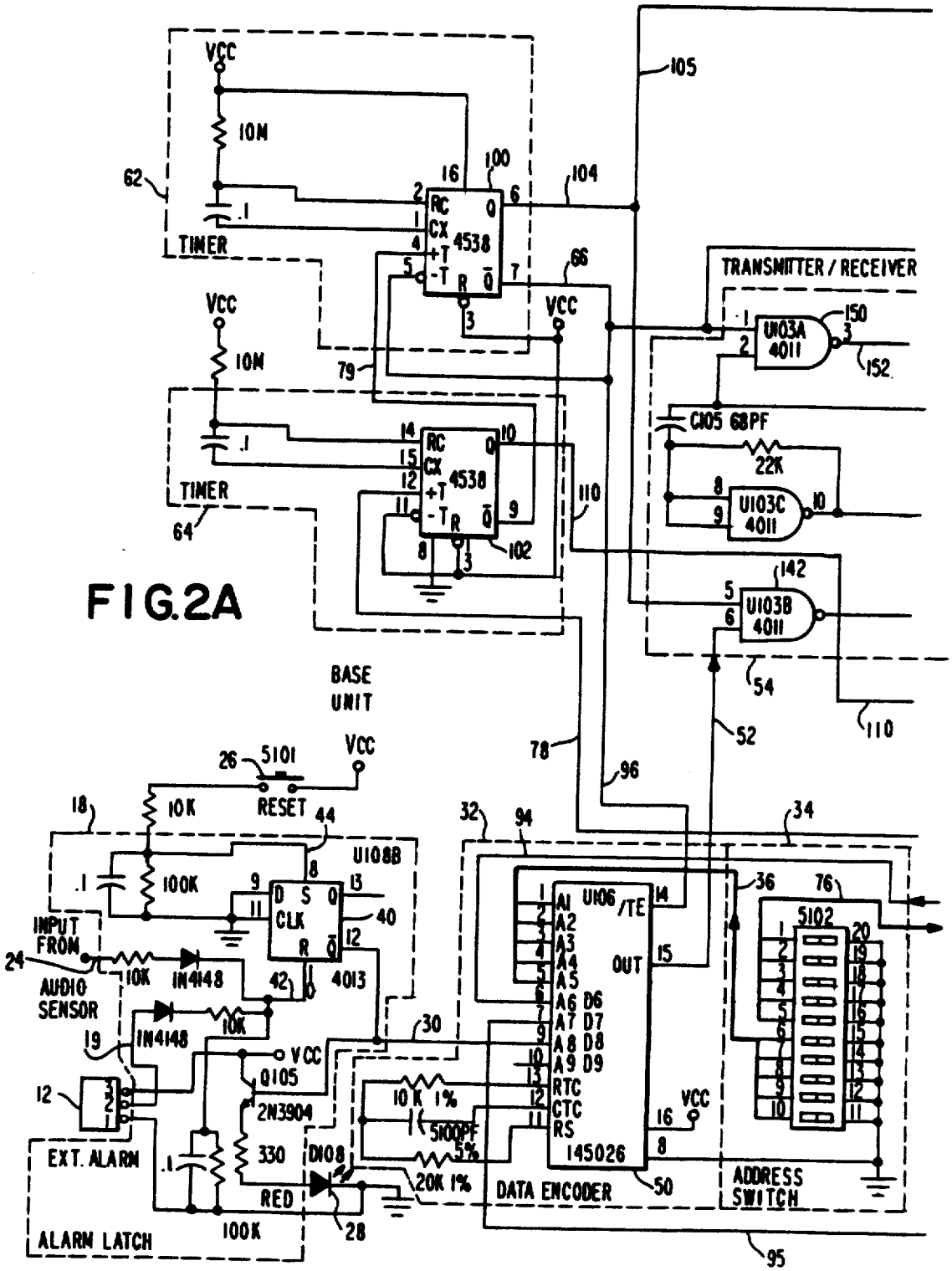
FIGS. 2A and 2B together provide a schematic diagram for the base unit of FIG. 1.

Turning now to a more detailed description of the present invention, there is illustrated in FIG. 1 a base unit 10 for an intrusion alarm condition advisory system. The base unit is an independent module which is capable of being mounted in a building, vehicle, or other location which is protected by an existing alarm system such as the system indicated generally at 12 in FIG. 1. The alarm system may be any conventional system capable of detecting an intruder and providing an alarm signal on output line 14. This alarm signal may be used to activate a suitable warning device such as a siren 16, or may be transmitted by way of line 17 to an automatic telephone dialer (not shown) or other warning equipment. The base unit 10 of the monitoring circuit of the present invention includes an alarm latch network 18 which may be electrically connected to the alarm system 12 by way of line 19 or which may respond to the siren 16 or other audio output from the alarm system by way of a suitable microphone 20 and an audio sensor circuit 22. Circuit 22 receives input signals from microphone 20 and produces an output which is supplied by way of line 24 to latch 18 when an audible alarm signal is received from system 12.

A manual reset button 26 is connected to the alarm latch 18 to set it for receiving inputs from the alarm system by way of lines 19 or 24, thereby placing the base unit in a reset condition. Illumination of lamp 28 indicates to the operator that the base unit has detected an alarm condition.

Receipt of an alarm signal on either of lines 19 or 24 trips the latch 18 and produces an output on line 30 which is supplied to a data encoder 32. An address switch 34 is also connected to the data encoder to provide address signals unique to the base unit 10 so that the unit will provide identifying address information on any transmitted data.

Once the alarm system 12 has been tripped, the latch 18 shifts to provide an alarm signal on line 30 which remains until the base unit is reset manually by switch 26. In this way, a remote unit can query the base unit at any time after the alarm 12 has been tripped and can determine that fact even if the siren 16 has shut down or the signals on line 14 have been discontinued, either through the elapse of a predetermined time, or because the intruder has managed to turn off or destroy the alarm, or because the intruder has left the protected premises.

As illustrated in the schematic diagram of FIG. 2A, the alarm latch 18 includes a C-MOS 4013 latching circuit 40 having its reset input 42 connected to the audio sensor line 24 and to the external alarm output line 19. The set input 44 of the latch 40 is connected to reset button 26 and the output of the latch is connected to output line 30 and by way of transistor Q105 to the lamp 28, whereby upon occurrence of an alarm signal on either line 19 or 24, the latch circuit 40 produces an output on line 30 which also turns off lamp 28. The signal on line 30 is connected to one input of a C-MOS 145026 encoder chip, indicated at 50 in the data encoder 32, while connector cable 36 from the address switch supplies address signals to appropriate inputs of the encoder chip.

One output from the data encoder 32 is supplied by way of line 52 to a radio frequency transmitter/receiver (transceiver) 54 which, in turn, is connected to an antenna 56. The RF transceiver 54 is switched between its receive and transmit modes by means of a transmit/-receive control circuit 58 connected to the transceiver by way of line 60. The control circuit is operated by a pair of timers 62 and 64 connected to the control circuit 58 by way of line 66 and activated by a data decoder 68. The decoder is responsive to signals received by the transceiver 54 and supplied by way of line 70, amplifier 72, and line 74 to one input of the decoder.

The transceiver 54 is normally in its receive mode, and upon receipt of a status inquiry, or retrieve, signal from a remote unit, sends that received signal by way of amplifier 72 to the data decoder 68. This decoder is connected to the address switch 34 by way of line 76 and determines whether the received signal is properly addressed. If so, the decoder produces an output on line 78 which activates timer 64. After a predetermined delay, timer 64 activates timer 62 by way of line 79 which, in turn, produces an output on line 66 which causes the control circuit 58 to switch transceiver 54 to its transmit mode for a predetermined period; for example 0.07 seconds. The transceiver then transmits information from the data encoder 32, which data identifies the status of the alarm latch 18.

The base unit may also receive "arm" and "disarm" signals from a remote unit which permit an operator to switch the alarm system on and off. Such signals are supplied through the amplifier 72 to the decoder 68, which supplies respective arm or disarm instruction signals by way of lines 80 or 82 to a status indicator circuit 84 which activates indicator lamps 86 or 88, respectively. The disarm instruction signal is also sent by way of line 90 to an alarm relay 92 which operates relay contacts 93 to switch the alarm system on or off, as required. Signals from the status indicator 84 are also supplied by way of lines 94 and 95 to the data encoder 32 for retransmission to the base unit to provide an indication that the base unit has responded to the control signals to arm to disarm the alarm. An output is provided from data encoder 32 by way of line 96 to the timer 62 to shift the transceiver 54 to a transmit mode after the base unit has been armed or disarmed.

Figure 2B:
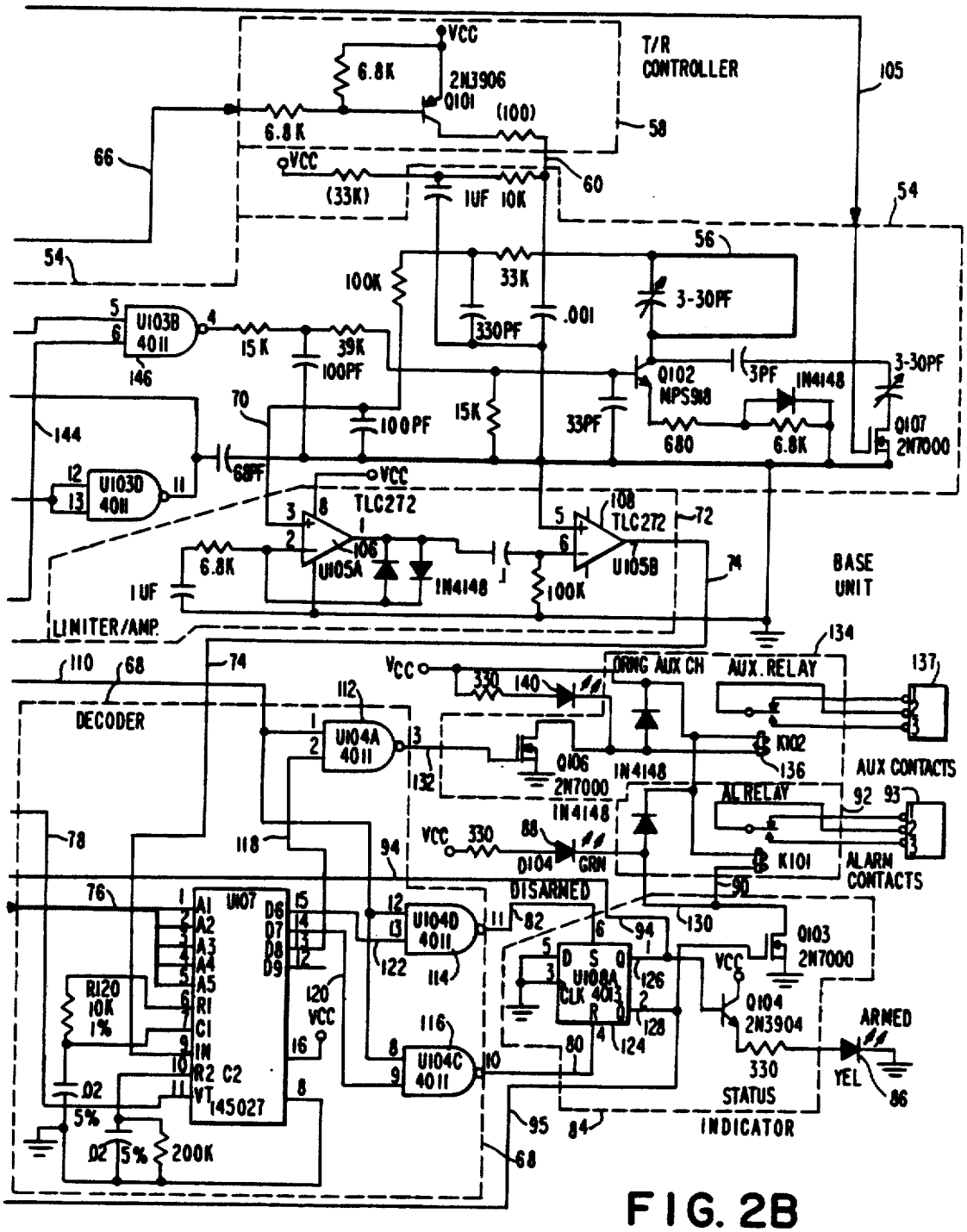

As illustrated in the schematic diagram of FIGS. 2A and 2B, the timers 62 and 64 incorporate two halves of a C-MOS 4538 which provides a pair of flip-flop pulse generators 100 and 102. The flip-flop 100 initially provides an output signal on line 104 which is supplied by way of line 105 to the RF transceiver 54 to turn on transistor Q107 to maintain the transceiver in its receive mode. Upon receipt of a signal from a remote unit by the antenna 56, a corresponding signal is supplied by way of line 70 to the input of amplifier/limiter 72, which includes a pair of TLC 272 amplifiers 106 and 108. The amplified signal is supplied by way of line 74 to the decoder 68 which is an MC145027 decoder. This element decodes five bits of the received signal as an address and four bits as data, compares the address bits with the input provided by way of line 76 from the address switch 34 and if a valid signal has been received, the decoder provides a signal on line 78 which triggers the pulse generator 102 in timer 64. At the end of a 1-second period, the pulse generator 102 produces a signal on line 79 which triggers the pulse generator 100 in timer 62. This pulse generator is also set for 1 second.

When timer 64 is triggered, it produces an output on line 110 which is supplied to the decoder to enable the 4011 AND gates 112, 114 and 116. The data received by way of line 74 at the decoder 68 is then supplied from decoder output lines 118, 120 and 122 to the second inputs of these AND gates. If the received signal on line 74 is an "arm" signal, gate 116 produces an output on line 80 which is supplied to one input of a 4013 flip-flop 124 located in the status indicator 84. The flip-flop then shifts to produce a signal on its output line 126 which shifts transistor Q104 to its conductive state to illuminate the "armed" indicator lamp 86. This leaves the alarm relay 92 in an "armed" positioned so that the alarm system connected to contacts 93 is armed; i.e., is in its on condition. If the received signal on line 74 is intended to disarm the alarm system, a signal is provided from AND gate 114 by way of line 82 to the status indicator 84, setting the flip-flop circuit 124 to produce an output on line 128. This output is supplied by way of an FET transistor Q103 to illuminate the "disarmed" indicator lamp 88 by way of line 130 and at the same time operates the alarm relay 92 by way of a signal on line 90, to shift the relay contacts 98 to turn the alarm system off.

The armed and disarmed signals appearing on lines 126 and 128, respectively, are supplied by way of lines 94 and 95 to corresponding inputs on the data encoder 32 so that the status of the base unit can be transmitted by the base unit when it is shifted to its transmit mode.

If the received signal from the remote unit is an auxiliary signal for use in operating an auxiliary unit such as a garage door opener, the base unit decoder 68 will produce a corresponding output on line 118 to thereby produce an output from gate 112. This auxiliary output will appear on line 132 and is supplied to an FET Q106 in an auxiliary relay circuit 134. Transistor Q106 controls the operation of a relay 136 to thereby operate relay contacts 137, and also controls the operation of an auxiliary indicator lamp 140.

At the end of the receive time period, timer 64 returns to its initial condition and timer 62 is triggered on for 1 second, thereby producing a trigger signal on line 104 which activates transistor Q107 in the RF transceiver 54. The signal on line 104 is also applied to one input of a 4011 AND gate 142 while the other input of gate 142 receives data from the data encoder 32 by way of the line 52. The output from AND gate 142 is supplied by way of line 144 to one input of a gate 146 in the transceiver circuit 54.

A second output on line 66 from timer 62 is supplied to the transmit/receive controller circuit 58, to switch a transistor Q101 to its on condition. This produces an output on line 60 which supplies battery power to the RF oscillator circuit in the transmit/receive circuit 54. The signal on line 66 is also supplied to one input of a gate 150 in the transmit/receive circuit 54, the output of which is applied by way of line 152 to the second input of gate 146. Gate 146 is enabled to permit the data from encoder 32 to be supplied through gate 146 to the base of transistor Q102 to pulse modulate the RF oscillator in the transmitter. In this way, the data relating to the status of the base unit is transmitted back to the remote unit. When the timer 62 times out, the base reverts to its normal receive mode.

If the alarm system detects an alarm condition, its output triggers the alarm latch 18, and the base unit of the monitoring system remains in that triggered mode until reset manually by the reset button 26. As long as the latch remains in the triggered mode, any status inquiry to the base unit will produce a warning signal at the remote unit.

Figure 4:
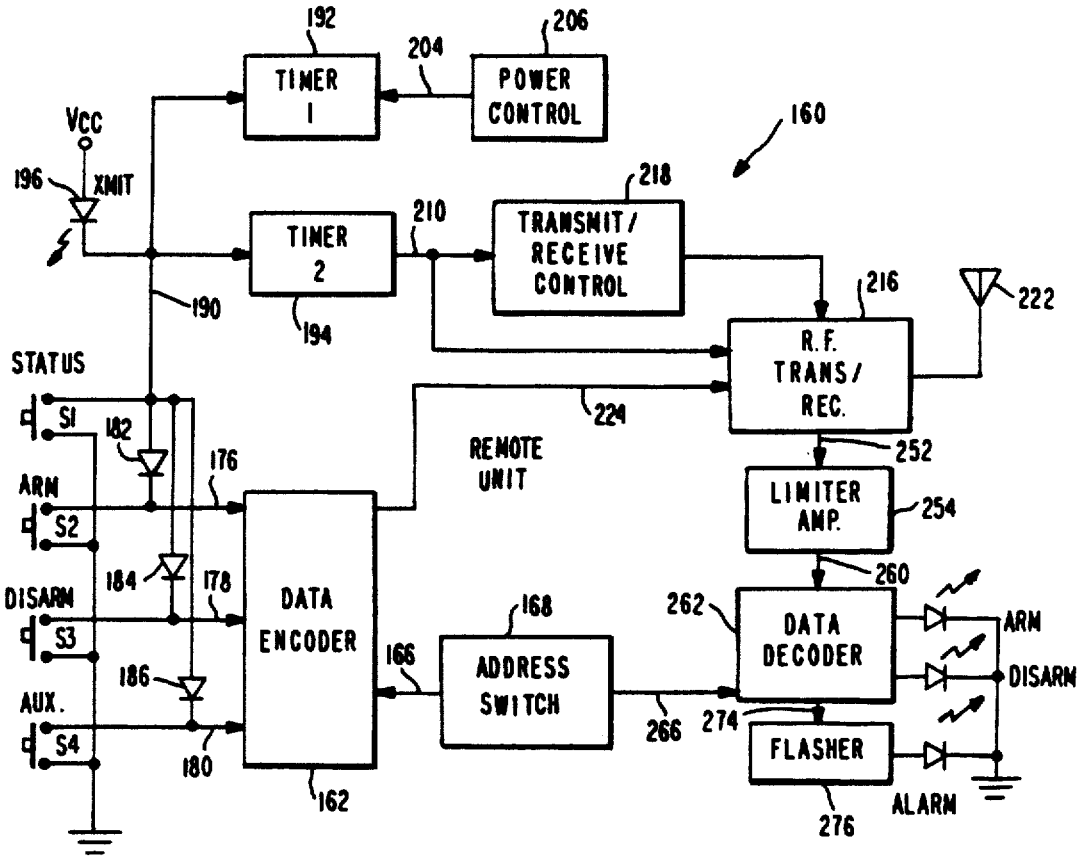
FIG. 4 is a block diagram of a remote unit for the alarm condition advisory system of the present invention.
Figure 5A:
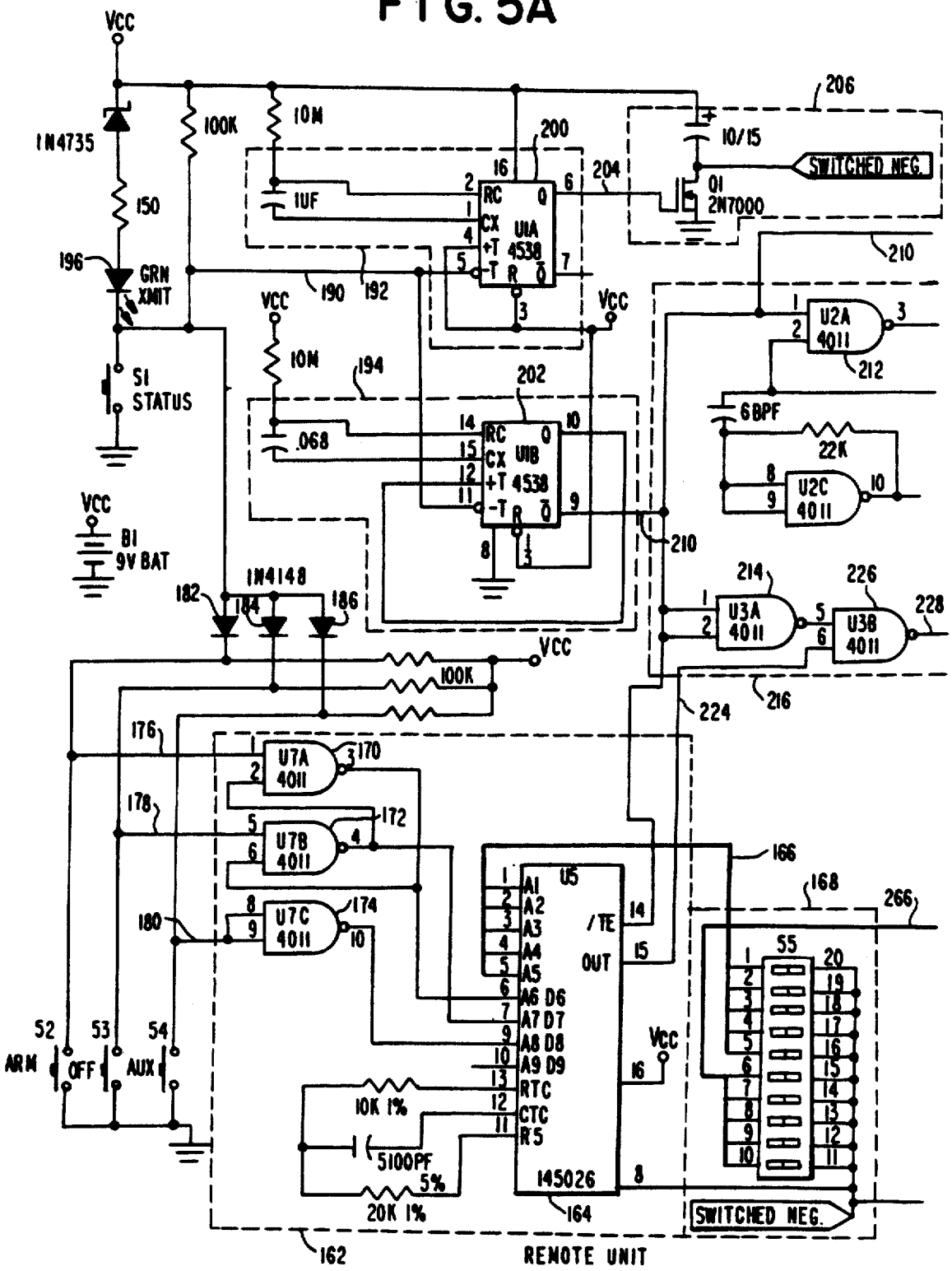
FIGS. 5A and 5B together provide a schematic diagram of the remote unit of FIG. 4.
Figure 5B:
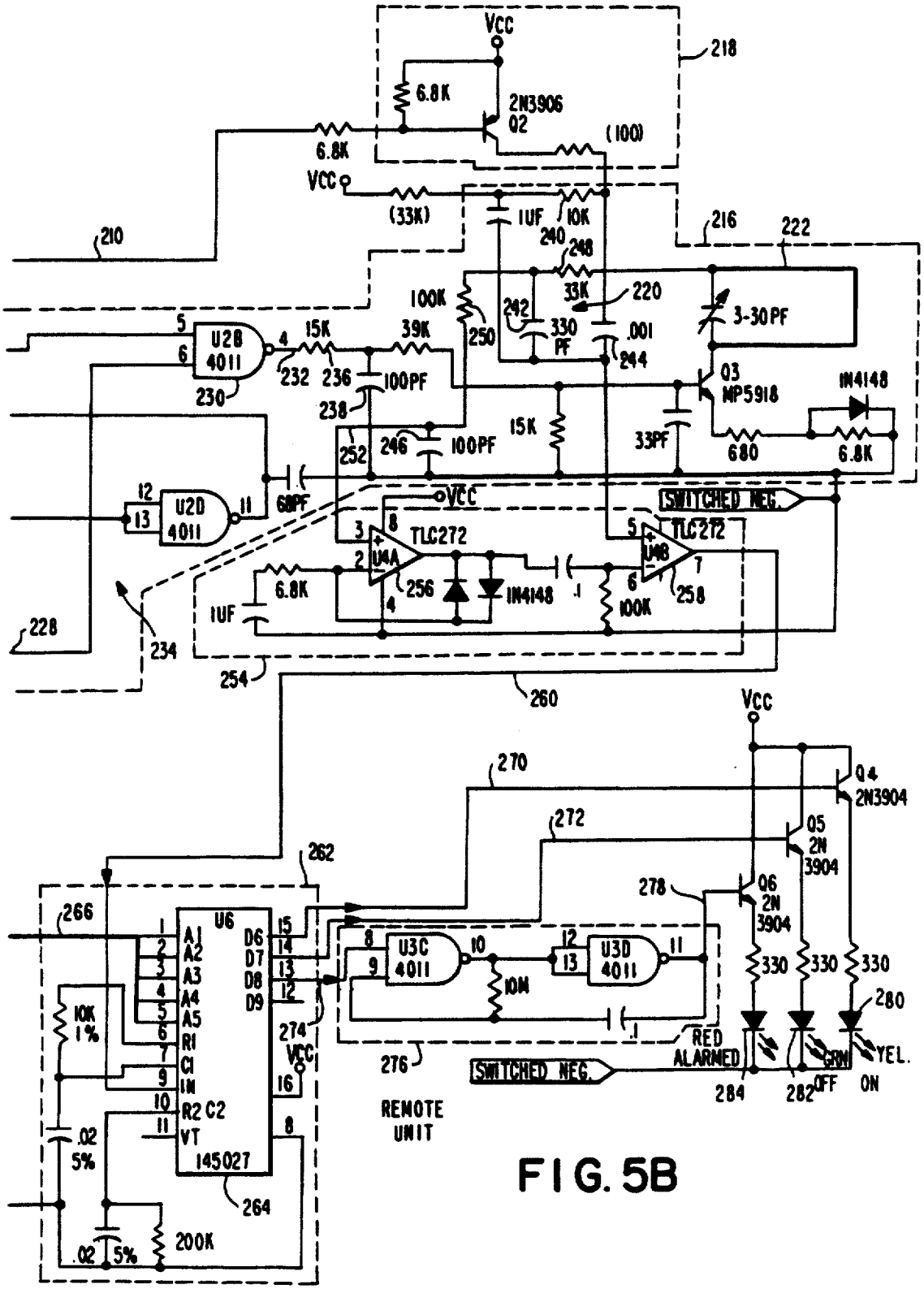

A suitable remote unit for use with the base unit of FIG. 1 is illustrated at 160 in the block diagram of FIG. 4 and in the schematic diagrams of FIGS. 5A and 5B. The remote unit is generally similar to the base unit, and includes a data encoder 162 which includes a C-MOS 14026 encoder chip 164 (FIG. 5A) and which is connected by way of cable 166 to an address switch 168. This address switch permits selection of the identifying address for the base unit, which address will be transmitted by the remote unit when the base unit is being queried. Also connected to separate inputs of the encoder 164 by way of AND gates 170, 172 and 174, respectively, are three control switches S2, S3 and S4 which serves to produce "arm" signals, "disarm" signals or "auxiliary" signals, respectively. These switches are connected to the respective AND gates by way of lines 176, 178 and 180. Also connected to all of the AND gates 170, 172 and 174 by way of corresponding diodes, 182, 184 and 186 is a status switch S1 which activates the remote unit to produce a status inquiry signal which is transmitted to a base unit. The switches S1–S4 are also connected by way of line 190 to a pair of flip-flop timers 192 and 194 as well as to a transmit indicator lamp 196 which is illuminated when the remote unit 160 is in its transmit mode.

Timers 192 and 194 incorporate C-MOS dual one-shot flip-flops 200 and 202 (FIG. 5A), both of which are triggered by depressing any one of the switches S1, S2, S3 or S4. When timer 192 is activated, it produces a signal on its output line 204 to turn on an FET transistor Q1 in a power control circuit 206 to connect battery power to the remainder of the circuit. This timer remains on for 10 seconds to allow the remote unit to transmit an inquiry or a control signal to the base unit and to receive in return a status indicator signal for activating a corresponding base status display on the remote unit.

The timer 194 has an on time of 0.07 seconds and when it is activated, it produces a signal on line 210 which is supplied to AND gates 212 and 214 in a radio frequency transmit/receive circuit 216 and also to the base of transistor Q2 in a transmit/receive control circuit 218. This transistor connects the transmitter RF oscillator tank 220 in the transceiver 216 directly to a bias voltage VCC to provide radio frequency power to a transmitting antenna 222. These oscillations are pulse modulated by a transistor Q3 which is driven by data from the data encoder 162 which is supplied to the transceiver 216 by way of line 224. The signal on line 224 is supplied to an AND gate 226 in the transceiver 216, the output of this gate being supplied by way line 228 to a further AND gate 230, the output of which is supplied by way of line 232 to the base of Q3.

During the 0.7 second on time of timer 194, gate 230 is enabled, transceiver 216 is in the transmit mode, and data from encoder 162 is supplied to the modulating transistor Q3 for transmission. This data may be a status inquiry, may be an arming signal, may be a disarming signal, or may be an auxiliary control signal, depending upon which of the switches S1 through S4 is depressed. These control functions are encoded as one of four data bits on a 9-bit data word provided by the encoder circuit 164.

For the balance of the 10 second interval during which timer 192 is on, the transistor Q2 in the transmit/-receive control circuit 218 is turned off and the transistor Q3 functions as a receiver, the oscillations of the transceiver circuit being quenched by the gating network generally indicated at 234 in transceiver 216 and the RC network consisting of resistor 236 and capacitor 238 connected to gate 230. This gating network creates a triangular wave from a 250 KHz square wave which is generated by the gating network 234 and smoothly quenches the 300 MHz oscillations of transistor Q3, thereby providing maximum sensitivity of the device as a receiver.

Data received by antenna 222 from the base unit transmission appears as a voltage across resistor 240 in the collector circuit of transistor Q3. A three pole filter with a cut off frequency of about 16 KHZ is formed by capacitors 242 and 244 in the network 220, by the capacitor 246, and by resistors 248 and 250. This filter supplies the data stream received by the remote unit by way of line 252 to a limiter amplifier 254 which incorporates a pair of operational amplifiers 256 and 258. These amplifiers limit the received signal and then supply the received data stream by way of line 260 to a data decoder 262 which incorporates a decoder chip 264.

The address switch 168 is connected to the decoder chip 264 by way of line 266 to provide address data for validation of the received signal. When valid data is received, the data is latched in the chip 264 and is supplied to either a transistor Q4 or a transistor Q5 by way of lines 270 and 272, respectively, or by way of line 274 to a flasher oscillator 276 which, when activated, produces an oscillating output on line 278 to drive transistor Q6. Transistors Q4, Q5 and Q6 drive corresponding indicator lamps 280, 282 and 284 to indicate whether the base unit is armed, disarmed, or whether an alarm condition has been detected, respectively. When an alarm condition has been detected, the indicator lamp 284 is caused to flash by the flasher circuit 276.

The indicator lamps 280, 282, and 284 remain on until the timer 192 times out and shuts off the power control circuit 206. This 10 second interval is reinitiated each time one of the buttons S1 through S4 is pressed, so that the remote unit will always receive and indicate the correct status of the base unit. The only circuit in the remote unit which remains connected to the battery after the timers 192 and 194 have timed out are the flip-flops 200 and 202, which draw very little current from the battery.

FIG. 7 illustrates a suitable power supply for the base unit 10 of FIG. 1. As illustrated, a 12 voltage power supply may be connected to an input terminal 290, with a backup battery pack 292 being provided. The power from the source 290 or 292 is supplied through a regulator 294 to supply a regulated voltage VCC to an output terminal 296.

Figure 8:
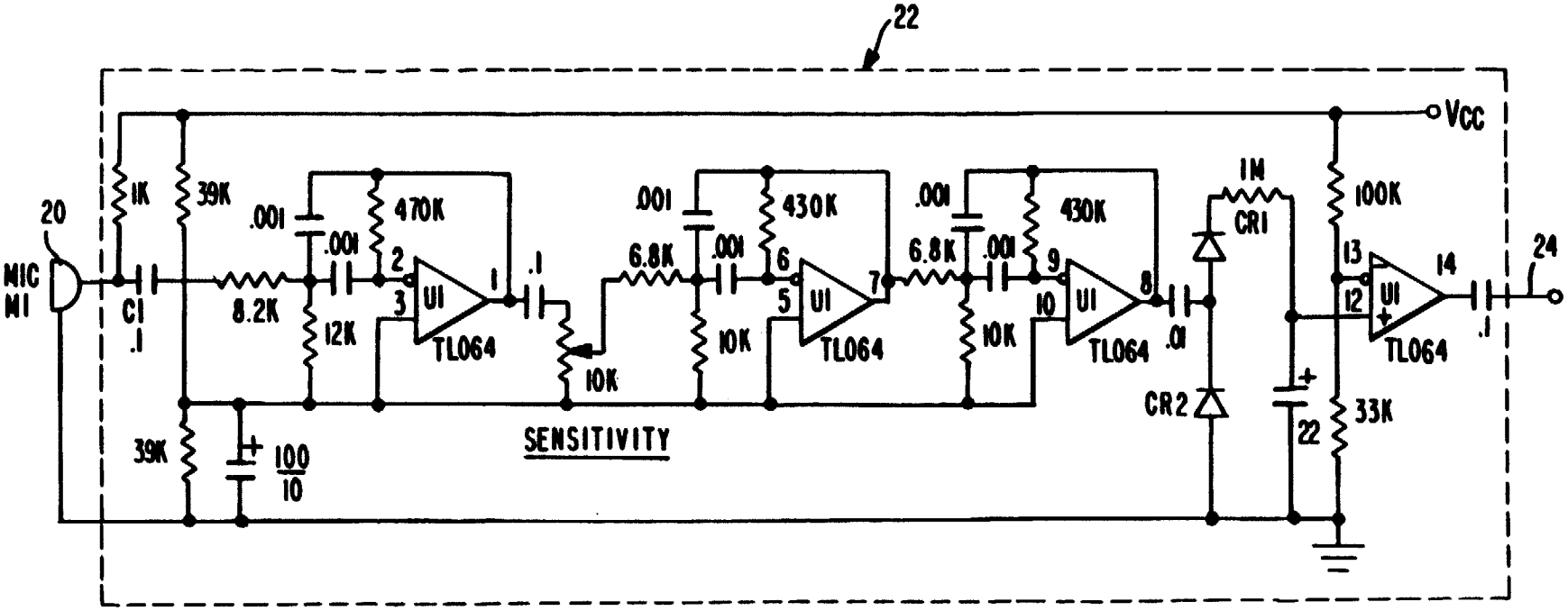
FIG. 8 is a schematic diagram of an audio sensor for the base unit.

FIG. 8 illustrates a schematic diagram for the audio sensor 22 of FIG. 1. This sensor circuit consists essentially of a 4-stage amplifier with a sensitivity adjustment to produce at output line 24 a suitable alarm signal upon detection of an audible sound preselected for detection. Suitable filters are provided to ensure that the sensor does not respond to audible signals other than those selected; more particularly, in a preferred form of the invention the filters are adjusted to limit the response of the sensor to the signals produced by the siren 16 or other selected alarm system annunciator.

In summary, the remote unit preferably is a hand-held unit which may be carried by the system operator and which may be used, for example, to close a garage door and then arm an alarm system and, upon return to the protected premises, determine the status of the alarm system. The base unit 10 is connected to the alarm system for arming it and disarming it, and for determining its status, and is also connected to an auxiliary control system such as a garage door opener, for operation of that auxiliary system. The remote unit 160 is activated by the operator to transmit a data signal instructing the base unit to carry out a selected operation. The base unit carries out that operation and returns a signal to the remote unit to indicate that the selected function has been completed. As indicated above, the selected function may be an arming of the alarm system at the protected premises, a disarming of that system, an instruction to carry out an auxiliary function, or a status inquiry to determine whether the alarm system had been tripped during the interval between the arming of the system and the status inquiry.

Although the present invention has been described in terms of a preferred embodiment, it will be apparent that numerous modifications and variations may be made without departing from the true spirit and scope thereof, as set forth in the following claims.

What is claimed is:

1. An alarm system monitor, comprising:

a base station at a location protected by an alarm system, and including means responsive to an alarm signal from an alarm system to produce an alarm condition in said base station, said base station remaining in such alarm condition after termination of said alarm signal;

base transceiver means in said base station, said transceiver having a normal receive mode and having a selectable transmit mode;

alarm latch and alarm encoder means in said base transceiver responsive to an alarm condition at said base station location for producing an alarm condition signal for transmission by said base transceiver when in its transmit mode;

a remote station at a location remote from said protected location;

remote transceiver means in said remote station, said remote transceiver having a transmit mode for transmitting status signals to activate said base station and to shift said base station to its transmit mode, said remote transceiver further including a receive mode to receive signals transmitted from said base station; and timer means in said base transceiver means responsive to a status signal received from said remote transceiver means and to said alarm condition signal to shift said base transceiver means from its normal receive mode to its transmit mode for a predetermined fixed time period, after which said base transceiver means reverts to its normal receive mode.

2. The monitor of claim 1, further including decoder means in said base station responsive to status signals transmitted by a remote transceiver.

3. The monitor of claim 2 wherein said base station further includes means including said decoder mean responsive to a selected one of a first, second and third status signals received from said remote station to arm said base station, to disarm said base station, and to interrogate said base station.

4. The monitor of claim 3, wherein said means responsive to said first and second signals to arm and disarm said base station includes relay means connectable to an alarm system to be monitored.

5. The monitor of claim 4, wherein said means in said base station responsive to said third station signals includes said timer means in said base transceiver, and further includes said encoder, whereby said third status signal interrogates said base station to determine the status of said alarm latch and said relay means.

6. The monitor of claim 5, wherein said remote station includes first, second and third status switch means;

remote encoder means in said remote station connected to each said status switch means for producing corresponding arm, disarm and interrogate signals; and means connecting said remote encoder means to said remote transceiver means for transmission of said arm, disarm and interrogate signals.

7. The monitor of claim 6, wherein said remote station further includes means responsive to said first, second and third status switch means for activating said remote transceiver in its transmit mode to transmit a selected one of said arm, disarm and interrogate signals.

8. The monitor of claim 7, wherein said means responsive to said status switch means includes timer means for activating said remote transceiver in its transmit mode for a preselected time and thereafter shifting said remote transceiver to its receive mode.

9. The monitor of claim 8, wherein said remote station further includes remote decoder means connected to said remote transceiver for receiving signals transmitted by said base transceiver.

10. The monitor of claim 9, wherein said remote station further includes indicator means connected to said remote decoder means and responsive to signals received from said base station transceiver to indicate the status of the alarm system being monitored.

11. The monitor of claim 10, further including reset means on said base station for resetting said latch means.

12. The monitor of claim 1, wherein said remote station includes first, second, and third status switch means connected to said remote transceiver for selectively transmitting first, second and third status signals.

13. The monitor of claim 12, wherein said base station further includes arming and disarming means connected to said base transceiver and responsive to said first and second status signals for arming and disarming said base station, said timer means in said base transceiver being responsive to said third status signals.

14. The monitor of claim 13, wherein said remote station further includes indicator means connected to said remote transceiver and responsive to the receipt of said alarm condition signals transmitted by said base transceiver.

* * * * *